United States Patent [19]

Cassarly

[11] 4,046,452

[45] Sept. 6, 1977

[54] ELECTRICAL CONNECTOR HOUSING HAVING AN IMPROVED LOCKING MEANS

[75] Inventor: James William Cassarly, Lewisberry, Pa.

[73] Assignee: AMP Incorporated, Harrisburg, Pa.

[21] Appl. No.: 568,545

[22] Filed: Apr. 16, 1975

[51] Int. Cl.[2] ..... H01R 9/02

[52] U.S. Cl. ..... 339/198 H

[58] Field of Search ..... 339/198 G, 198 H, 198 R, 339/198 GA, 198 S, 198 P

[56] References Cited

U.S. PATENT DOCUMENTS

| | | | |
|---|---|---|---|
| 3,537,061 | 10/1970 | Haag et al. | 339/31 M |
| 3,676,833 | 7/1972 | Johnson | 339/176 M |
| 3,829,821 | 8/1974 | Derr et al | 339/176 M |

*Primary Examiner*—Roy Lake
*Assistant Examiner*—Howard N. Goldberg
*Attorney, Agent, or Firm*—Allan B. Osborne

[57] ABSTRACT

This invention relates to an insulated housing for an electrical connector and more particularly to a housing adapted for locked assembly with like housings. The improved locking means cooperatingly resides on the rear of adjacent housings and consists of a flexible beam on one housing that snaps into an opening located in the adjacent housing. Each housing contains two flexible beams, one each on two adjacent sides, and two openings one each on the other two adjacent sides. Two or more housings may then be locked together in both vertical and horizontal directions.

2 Claims, 2 Drawing Figures

ELECTRICAL CONNECTOR HOUSING HAVING AN IMPROVED LOCKING MEANS

BACKGROUND OF THE INVENTION

Stacking two or more housings in banks; i.e., in both vertical and horizontal directions, have been disclosed in U.S. Pat. No. 3,259,970, the disclosure of which is incorporated herein by reference. Therein, each housing contained lateral cutouts; i.e., semi-circular grooves extending down each side, which formed circular openings when two housings were placed side-by-side and latched together by means of tongues and grooves. The housings were then locked together so as to prevent longitudinal displacement one with another by means of a rod passing through the circular openings and secured therein by frictional means or otherwise. Obviously, the locking system requires components external to the housings; i.e., the rods. Further, in the event the rods have matable parts e.g., a nut and bolt arrangement, tools are required to lock and unlock the assembly. Also, in a bank of several housings, a single housing cannot be separated therefrom or added without undoing the entire system.

Accordingly, it is an object of the present invention to provide electrical connector housings having integral locking means which secure adjacent housings together.

It is another object of the present invention to provide electrical connector housings having integral locking means that do not require any tools.

It is yet another object of the present invention to provide electrical connector housings having integral locking means which permit the removal of a single housing from anywhere within a bank without disturbing the remaining housings and also to add a housing to a bank without disrupting the other secured housings.

DESCRIPTION OF THE PREFERRED EMBODIMENT

Figure 1:
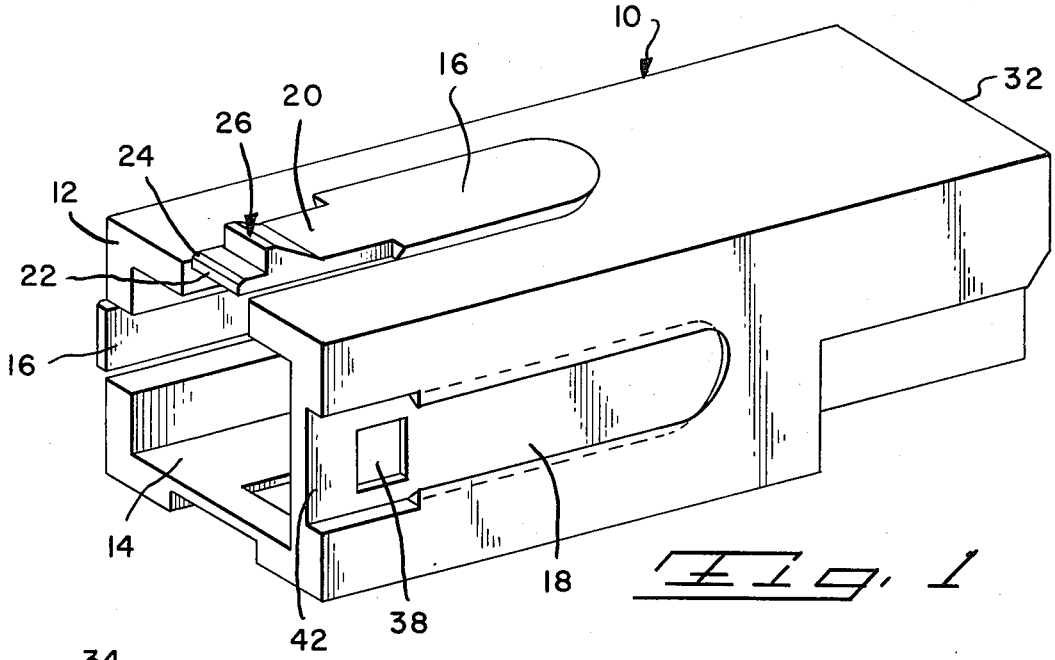
FIG. 1 is a perspective view of an electrical connector housing constructed in accordance with the present invention.

Referring now to the drawings wherein like reference numerals represent like parts in both figures, there is shown in FIG. 1 a housing 10 molded from an insulating material such as polycarbonate. The view in FIG. 1 is taken looking at the rear face 12 and into passageway 14 which extends longitudinally through the housing. Two adjacent sides of housing 10 have thereon longitudinally extended dovetail tongues 16 while the other two adjacent sides contain correspondingly shaped grooves 18. One housing may be laterally connected to another like housing by inserting tongue 16 on one housing into groove 18 of the second housing and slidingly seat the tongue in the groove. This may be seen in FIG. 2.

Figure 2:
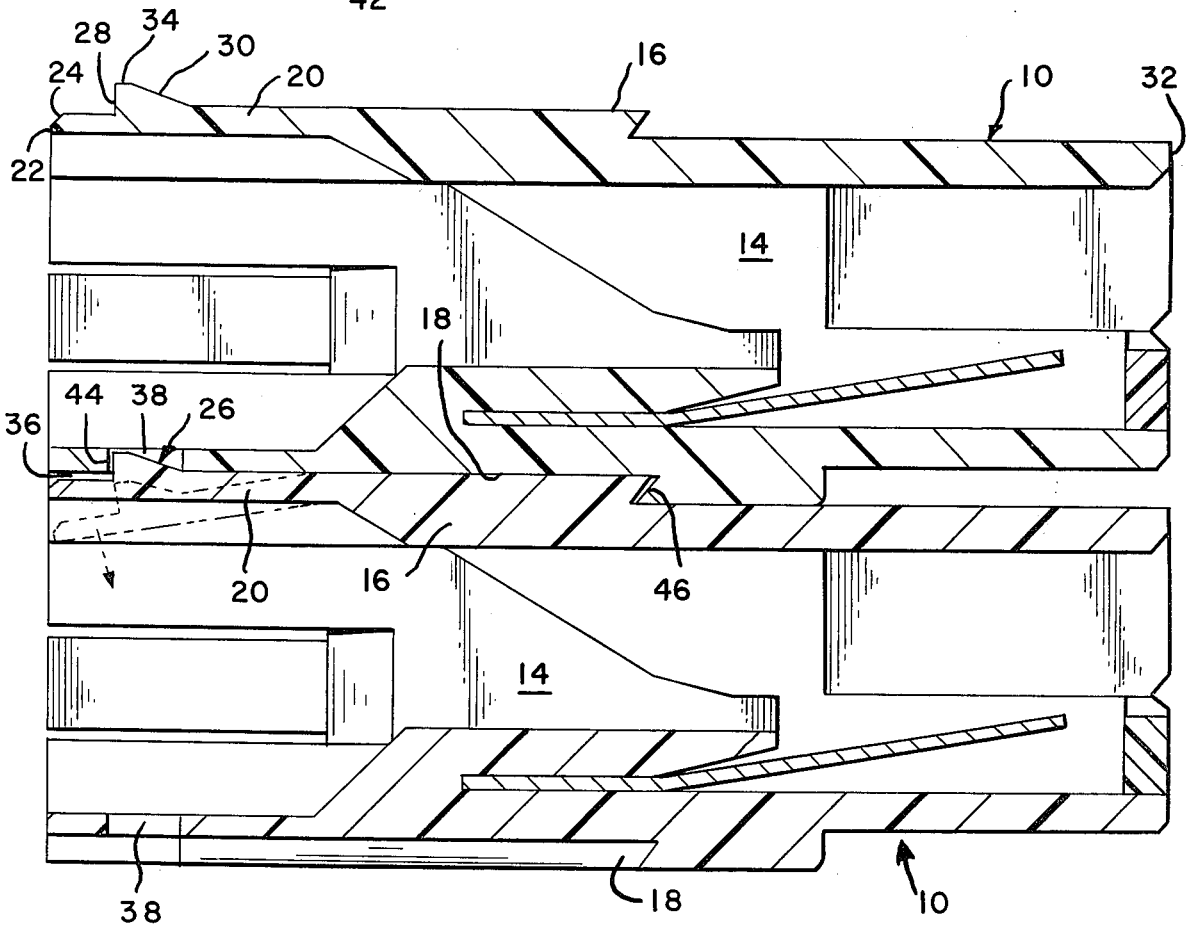
FIG. 2 is a cross-sectional view of a pair of joined housings showing the locking means.

Extending rearwardly on each tongue 16 is a flexible beam 20. The upper edge of its free end 22 is beveled as indicated by reference numeral 24. An outwardly projecting boss 26 is found positioned on beam 20, spaced inwardly from end 22. The rearwardly facing side 28 of the boss is straight and at right angles to the plane of the beam. The forwardly facing side 30 of the boss slopes downwardly toward front end 32 of housing 10. The top of the boss is flat as indicated by reference numeral 34. As shown more clearly in FIG. 2, the thickness of beam 20 is thinner between its free end 22 and boss 26 than the portion in front of the boss. Material has been removed from the top of the beam so that a gap, indicated by reference numeral 36 in FIG. 2, is present between the beam and an adjacent housing in a connected relation. Beam 20 is flexible over a limited distance with the plane of movement at right angles to the side of the housing on which the beam is located.

Each groove 18 has an opening which is spaced inwardly from the rear face 12 and at the same distance as is boss 26. The dimensions of the opening is such as to receive the boss therein. The dashed lines 40 seen along the sides of the groove indicate the dovetail construction. The enlargement of the groove in the vicinity of opening 38 reflects a molding requirement well known to those engaged in that art and is of no inventive importance here.

As is apparent, details given of housing 10 have been limited to the tongue 16 and groove 18. The remainder of the housing has been ignored for the reason that the type of housing is not part of the invention; i.e., the invention is suitable for any kind of housing wherein a lateral stacking and locking capability is desired.

The utility of the locking means disclosed herein will now be discussed with specific reference to FIG. 2.

To connect the two housings together, tongue 16 of the lower housing was inserted into the rear 42 of groove 18 of the upper housing. As the lower housing is pushed forward, the sloping side 30 on boss 26 engages the edge of the upper housing and beam 16 is deflected downwardly into a notch cut through the side of the housing below the beam. As the boss clears the rear wall 44 defining opening 38, the stored energy in the deflected beam pops the boss into the opening, thereby locking the two housings together. Rearward travel of the upper housing and forward travel of the lower housing is prevented by interference between the tongue and groove at the forward ends thereof, indicated by reference numeral 46. Forward travel of the upper housing and rearward travel of the lower housing is prevented by interference between the straight side 28 on boss 26 and the rear wall 44 of opening 38.

The two housings may be released from locking engagement by simply moving beams 20 inwardly; i.e., into passageway 14, so that boss 26 clears opening 38 and then moving the lower housing rearwardly or the upper housing forwardly. The path that beam 20 takes as it is depressed is shown by the dashed lines and arrow in FIG. 2. The gap 36 and the beveled portion 24 on free end 22 on the beam facilitates moving the beam inwardly by means of one's fingernail, a screwdriver or like tool.

The foregoing detailed description has been given for clearness of understanding only, and no unnecessary limitations should be understood therefrom, as some modifications will be obvious to those skilled in the art.

What is claimed is:

1. An electrical connector housing, generally rectangular in cross-section, having a passage extending longitudinally through for housing an electrical contact member, an elongated dovetail tongue positioned externally on at least one side of said housing, said tongue being positioned intermediate the two ends of the housing, a notch in each said side extending from the housing rear face forwardly to the tongue, a flexible beam integral with and extending rearwardly from said tongue in alignment with the notch, said beam having an outwardly projecting boss thereon with a straight side face rearwardly, a groove positioned on at least a second side of said housing, which is opposed to said first side, extending inwardly from the housing rear face and adapted to slidingly receive a tongue on an identical housing therein, further including an opening in the floor of said groove adjacent the housing rear face, whereby as the tongue on an identical housing slides into said groove, the flexible beam thereon becomes resiliently depressed into the notch until the boss thereon enters the opening thereby holding the two housing in the laterally assembled relation.

2. An electrical connector housing, comprising:

an elongated housing generally rectangular in cross-section, having a passage extending longitudinally through for housing an electrical contact member, an elongated dovetail tongue positioned externally on each of two adjacent sides, said tongues being positioned intermediate the two ends of the housing, a notch in each of the same two adjacent sides extending from the housing rear face forwardly to the tongue, a flexible beam integral with and extending rearwardly from each of the tongues in alignment with the notch, said beam having an outwardly projecting boss thereon with a straight side facing rearwardly, a groove positioned on each of the other two adjacent sides extending inwardly from the housing rear face and adapted to slidingly receive a tongue on an identical housing therein, further an opening in the floor of each groove adjacent the housing rear face, whereby as the tongue on an identical housing slides into one of said grooves, the flexible beam thereon becomes resiliently depressed into the notch until the boss thereon enters the opening thereby holding the two housings in the laterally assembled relation.

* * * * *

UNITED STATES PATENT OFFICE

CERTIFICATE OF CORRECTION

PATENT NO. : 4,046,452

DATED : September 6, 1977

INVENTOR(S) : JAMES WILLIAM CASSARLY

It is certified that error appears in the above-identified patent and that said Letters Patent are hereby corrected as shown below:

Claim 1, column 3, line 3, after "side" delete "face" and insert therefore - - - facing - - - .

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*